US010421202B2

(12) United States Patent
Erndt et al.

(10) Patent No.: US 10,421,202 B2
(45) Date of Patent: Sep. 24, 2019

(54) BLADE, SHAVER WITH A BLADE AND METHOD FOR PRODUCING A BLADE

(71) Applicant: Braun GmbH, Kronberg (DE)

(72) Inventors: Andreas Erndt, Kelkheim (DE); Thorsten Piesker, Friedrichsdorf (DE); Ines Herzenstiel, Kelkheim (DE)

(73) Assignee: Braun GMBH, Kronberg (DE)

( * ) Notice: Subject to any disclaimer, the term of this patent is extended or adjusted under 35 U.S.C. 154(b) by 96 days.

(21) Appl. No.: 15/492,092

(22) Filed: Apr. 20, 2017

(65) Prior Publication Data

US 2017/0312927 A1 Nov. 2, 2017

(30) Foreign Application Priority Data

Apr. 27, 2016 (EP) ..... 16167261

(51) Int. Cl.
*B26B 19/10* (2006.01)
*B26B 19/04* (2006.01)
*B26B 19/38* (2006.01)

(52) U.S. Cl.
CPC ..... *B26B 19/10* (2013.01); *B26B 19/042* (2013.01); *B26B 19/384* (2013.01); *B26B 19/3893* (2013.01)

(58) Field of Classification Search
CPC ... B26B 19/384; B26B 19/3893; B26B 19/10; B26B 19/042
See application file for complete search history.

(56) References Cited

U.S. PATENT DOCUMENTS 6,293,017 B1 * 9/2001 Sato ..... B26B 19/10 30/346.51
9,969,093 B2 * 5/2018 Piesker ..... B26B 19/12
2005/0274019 A1 * 12/2005 Inoue ..... B26B 19/042 30/43.7
2007/0157762 A1 * 7/2007 Frechette ..... B26B 19/384 76/104.1

* cited by examiner

*Primary Examiner* — Omar Flores Sanchez
(74) *Attorney, Agent, or Firm* — Ronald T. Sia; Kevin C. Johnson

(57) ABSTRACT

An elongated outer blade for a slit cutter is disclosed. The outer blade extends along a first axis and comprises a number of slits and webs disposed between the slits. The webs have an upper surface, a lower surface and side surfaces extending between the upper and lower surfaces. At least some of the webs are provided with a concave clearance formed between a side surface and the lower surface forming an edge with the side surface. Further, a shaver having such an outer blade and a method for producing an outer blade using etching are disclosed.

13 Claims, 4 Drawing Sheets

BLADE, SHAVER WITH A BLADE AND METHOD FOR PRODUCING A BLADE

FIELD OF THE INVENTION

The invention relates to an elongated outer blade for a slit cutter. The blade may extend along a first axis and preferably comprising a number of slits and webs disposed between the slits. The webs may have an upper surface, a lower surface and side surfaces extending between the upper and lower surfaces. The invention further relates to a shaver comprising such a blade and a method for producing such a blade.

BACKGROUND OF THE INVENTION

Electric shavers with a slit cutter suitable for cutting relatively long hairs are known for example from EP 0 693 988 B1 and EP 1 410 884 B1. The slit cutters comprise an outer blade as defined above and an inner blade driven by a motor to move in sliding contact with the outer blade. Embodiments of the outer blade known from EP 0 693 988 B1 and EP 1 410 884 B1 have a partially H-shaped configuration with a central web extending substantially along the first axis and with further webs protruding from the central web along a second axis which is substantially oblique or perpendicular to the first axis. As an alternative, it is known that the web has a meander form. In addition, guards may be provided on either side of the slit cutter preventing that skin is pinched in the shaver.

Further shavers with a slit cutter having an elongated outer blade as defined above are known from EP 1 930 135 B1 and US 2010/0175258 A1.

Slit cutters are typically used as long-hair cutters or pre-cutters with which longer beard hairs are to be shortened before the use of e.g. foil-type short hair cutting systems, in order to improve shaving time and the shaving result. It is known that the shaving result can be improved by mechanically preparing the skin that is to be shaved, in order, for example, to lift up beard hairs.

For slit cutters, a proper shaving result requires that hairs enter into the slits between the webs such that they are cut by interaction of the outer blade with an, e.g. oscillating, inner blade. This is especially difficult with hairs having an orientation substantially parallel to the skin. One approach is to reduce the thickness of the outer blade, thereby increasing the number of hairs which may be cut by entering the slits between the webs. However, in addition to the issue of sturdiness of the structure, too thin outer blades can cause skin irritations.

SUMMARY OF THE INVENTION

It is accordingly one object of the present invention to provide a blade for a shaver and a method for producing such a blade which blade improves the shaving result while avoiding skin irritations.

This object is solved by a blade according to claim 1. At least some of the webs of the blade are provided with a concave clearance formed between a side surface and the lower surface forming an edge with the side surface. In other words, in a sectional view of the respective web the clearance forms an arched space extending between a portion of the side surface and a portion of the lower surface. The concave clearance has the effect that the webs do not block hairs from entering the slits but rather guide hairs having an orientation substantially parallel to the skin towards the inner blade. In addition, the edge formed by the clearance tends to fix hairs within the slits, thereby preventing hairs from slipping out of the slits and preventing that hairs are clamped between the skin and the outer side of the blade. As the clearance is formed adjacent to the lower surface of the respective web, the risk of skin irritation by the edge is reduced.

The clearance may form an obtuse angle with the side surface and/or with the lower surface. With this configuration the edge formed by the clearance is sufficiently sharp to guide and/or clamp hairs while substantially avoiding skin irritations. As an alternative, the clearance may form an acute angle with the side surface and/or with the lower surface which results in a sharper edge.

Preferably, the blade has, at least in portions, an H-shaped or meander shape configuration. For example, a central web may be provided extending along the first axis with further webs protruding from the central web and extending along a second axis which is oblique or perpendicular to the first axis. Further, the blade may comprise lateral wall elements extending perpendicular to the first axis and perpendicular to the second axis. The lateral wall elements may be connected with each other and/or with webs by at least one, e.g. U-shaped, bridge element.

The clearance may be provided at any side surface of the blade. Preferably, at least some of the webs extend along the second axis, i.e. substantially perpendicular to the first axis, wherein a clearance is provided at least in a side surface facing in the direction of the second axis.

Skin irritations may be further reduced with the edge formed between a side surface and the upper surface of a respective web being a rounded edge. As an alternative, this edge may be substantially rectangular. As a further alternative, at least some of the webs may be provided with a further concave clearance formed between a side surface and the upper surface forming an edge with the side surface. The further clearance may improve hair guiding and/or clamping. The curvature and/or size of the clearances may be identical or may differ, e.g. with a smaller clearance provided adjacent the upper surface. If a further clearance is provided adjacent the upper surface, the concave clearance and the further concave clearance are preferably spaced from each other by a portion of side surface.

According to a further aspect of the invention, an electric shaver is provided comprising a motor, at least one slit cutter having an elongated outer blade as defined above and an inner blade driven by said motor to move in sliding contact with the outer blade.

The shaver may have at least one guard, e.g. extending parallel to the first axis, adjacent to the slit cutter. The at least one guard may have a comb structure with teeth and slots provided between the teeth. For example the guard may be designed as described in EP 1 410 884 B1 or as described in unpublished European application 15200807.4.

In addition, the shaver may comprise at least one foil-type cutter for shorter hairs which is preferably driven by the same motor as the slit cutter.

According to a further aspect of the invention, a method for producing an elongated outer blade is provided comprising the steps of providing a foil of a metallic material comprising a number of slits and webs, applying a protective layer at least on regions of at least one side of the webs, exposing the at least one side of the webs to an etching agent thereby forming a concave clearance between a side surface and the lower and/or upper surface of the respective web. Producing the respective clearance by etching allows provision of a well-defined edge and guiding structure in the side surface even with mass production of relatively thin foils. In addition, one or more etching steps may be implemented into the manufacturing process of an upper blade without undue effort.

The clearance may be produced by photo-etching. Preferably, the protective layer comprises a photoresist, wherein regions of the at least one side of the webs are exposed to light, thereby selectively curing the photoresist, and wherein un-cured photoresist is removed prior to exposing the at least one side of the webs to the etching agent. The protective layer is typically removed after exposing the at least one side of the webs to the etching agent.

The at least one rounded edge may be formed between a side surface and the upper surface of at least some of the webs by an abrasive method, like a chip-removing process.

Further aspects of the invention are mentioned and explained in the following detailed description of example embodiments according. It is to be noted that these aspects are explained with reference to certain embodiments of the invention. These embodiments might realize one or more of the different preferred features. The different aspects or features with the related advantages and effects as described and/or evident for the one skilled might be combined without departing from the present invention in any useful combination. The one skilled in the art will acknowledge that any combination of the different aspects or features of the following disclosure in the description and/or the drawings is useful for specific aspects of the invention, even without combination with other aspects or features disclosed together in one embodiment.

DETAILED DESCRIPTION OF THE INVENTION

The invention is disclosed in the following by way of exemplary embodiments realizing different features and aspects of the invention.

Figure 1:
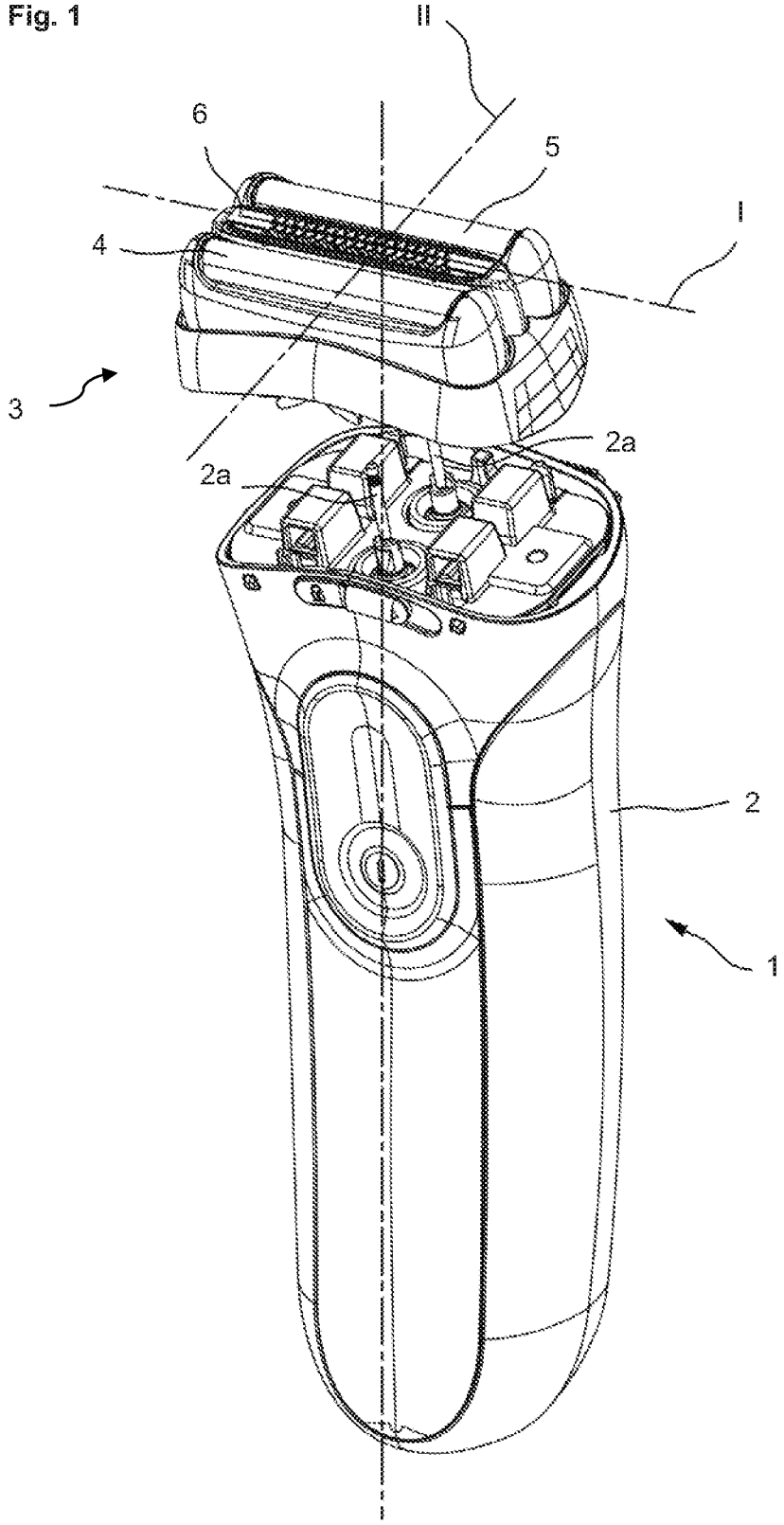
FIG. 1 shows a three-dimensional view of an electric shaver.
Figure 2:
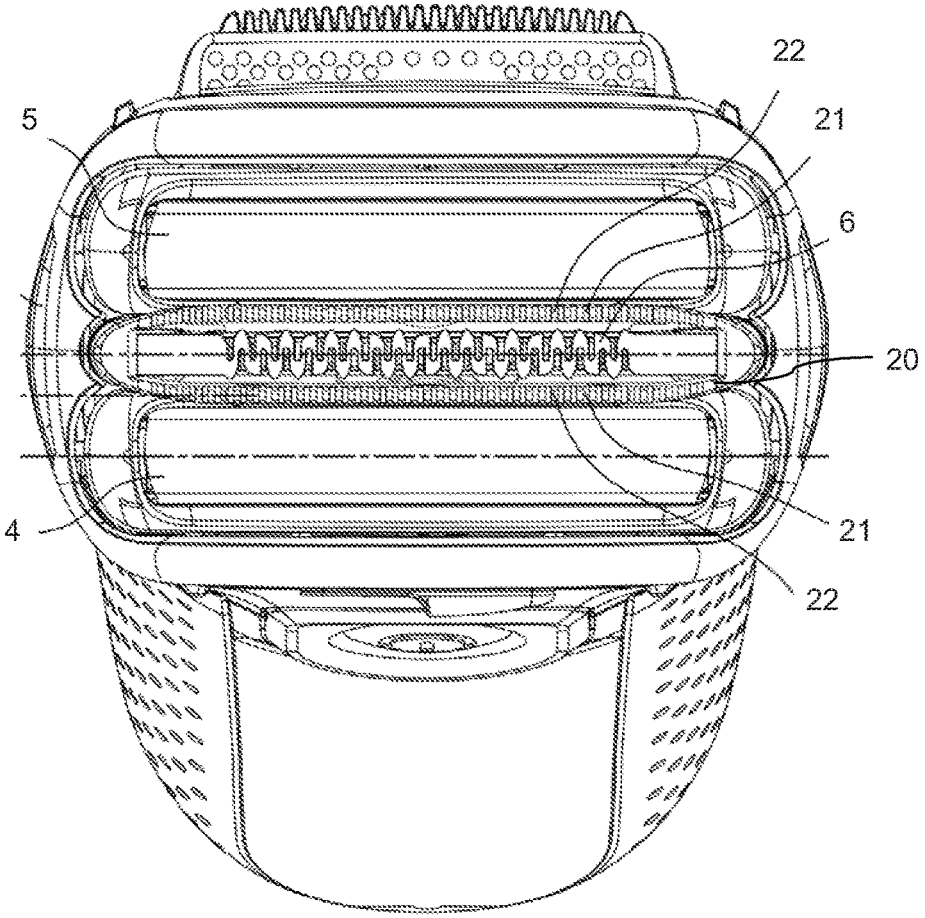
FIG. 2 shows a top view of the shaver of FIG. 1.

FIG. 1 is an example for an electric shaver 1 comprising a body 2 which may house a, preferably rechargeable, battery and/or an electric motor. A shaver head 3 is, e.g. in a releasable manner, attached to the body 2. As can be seen in FIG. 2, the shaver head 3 comprises two foil-type cutter units 4, 5 and a slit cutter 6 which is arranged interposed between the foil-type cutters 4, 5. The foil-type cutter units 4, 5 typically comprise a foil-type outer blade with a plurality of openings allowing hairs to pass there through and an inner blade driven by the motor to perform an oscillating movement during use to shear off hairs. Drive pins 2*a* may be provided for transmitting a driving motion or force from the motor to the foil-type cutter units 4, 5 and to slit cutter 6. The foil-type cutter units 4, 5 and slit cutter 6 are elongate components which substantially extend along a first longitudinal axis I. A second axis II extends in a direction perpendicular to the first axis I.

Figure 3:
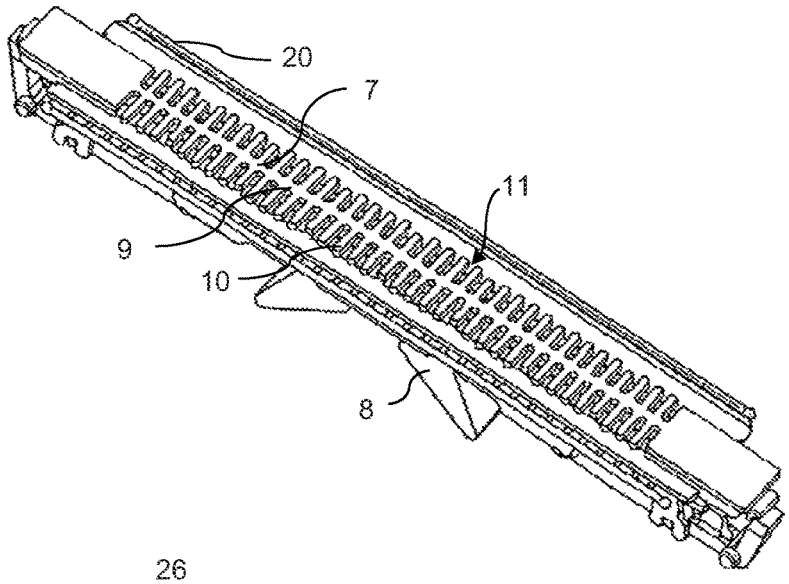
FIG. 3 shows a perspective view of a prior art upper blade and a lower blade.

The design of a slit cutter 6 is shown in FIG. 3 in more detail. The slit cutter 6 comprises an outer blade 7 and an inner blade 8 driven by the motor to perform an oscillating movement during use to shear off hairs. The inner blade 8 may comprise a series of arch-shaped elements (cf. FIGS. 4 and 5). In the embodiment of FIG. 3, the outer blade 7 has an elongate form extending along the first axis I. The outer blade 7 comprises a central web 9 extending along the first axis I and a series of lateral webs 10 extending along the second axis II which is perpendicular to the first axis I. In other words, outer blade 7 of FIG. 3 has an H-shaped configuration. Slits 11 are provided between lateral webs 10. Lateral webs 10 and slits 11 provide for a comb-like configuration of the outer blade 7.

As an alternative to the H-shaped configuration, the outer blade may have a meander shape as shown in FIG. 2. The outer blade of FIG. 2 has a single web with the form of a wiggly line forming slits between the arches.

Figure 4:
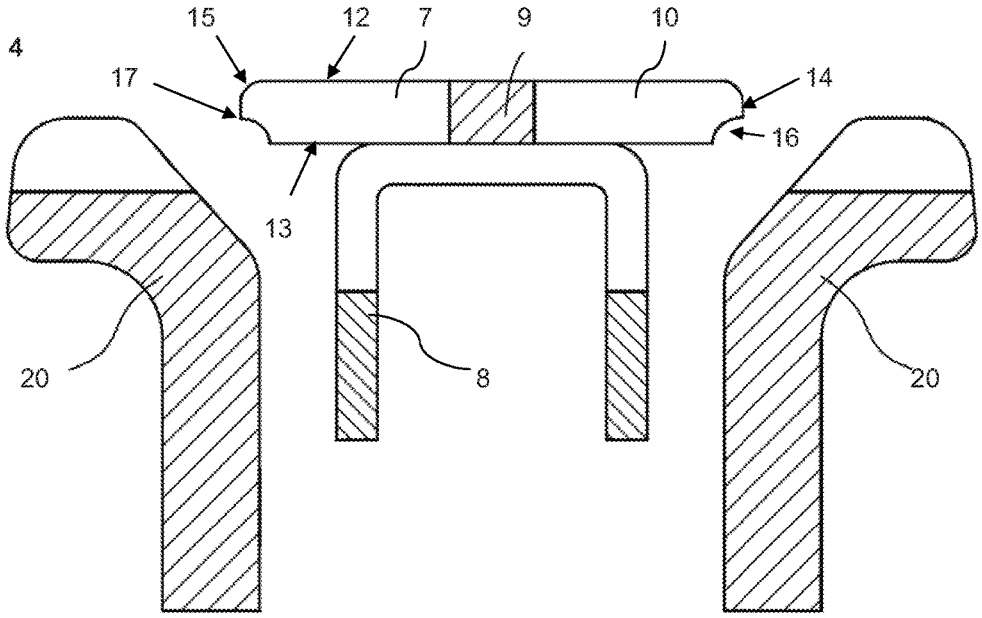
FIG. 4 shows a sectional view of an upper blade according to the invention with a lower blade.

FIG. 4 shows an outer blade according to a first embodiment of the invention. In the depicted embodiment, the outer blade 7 has the H-shaped configuration of FIG. 3 with a central web 9 and lateral webs 10 with slits 11 between the lateral webs 10. However, the design of the outer blade 7 may depart from the H-shaped configuration and may have a meander shape, for example. In FIG. 4 the lateral webs 10 have an upper surface 12, a lower surface 13 and a side surface 14 facing in the direction of the second axis II. The upper edge 15 between the upper surface 12 and the side surface 14 is designed as a rounded edge to reduce skin irritations during contact with the skin. As an alternative, the upper edge 15 may have a substantially rectangular form. The rounded upper edge 15 may be formed by an abrasive method, e.g. buffing, preferably without exerting high mechanical and/or thermal loads to the outer blade 7.

A concave clearance 16 is provided adjacent to the lower surface 13 and the side surface 14. A sharp edge 17 is formed by the clearance 16 at the position where the clearance 16 meets with the side surface 14. The concave surface of clearance 16 forms an obtuse angle with the side surface 14 at edge 17. As an alternative, this angle may be rectangular or acute.

The clearance 16 has the effect of reducing the height of lateral web 10 at its lateral end. This facilitates that the lateral web 10 passes between the skin and a hair, thereby guiding the hair towards the central web 9 and the inner blade 8. The concave shape of clearance 16 further supports the guiding function of the lateral side of web 10. With this design, outer blade 7 improves the shaving result especially for hairs having an orientation substantially parallel to the skin without causing skin irritation.

Figure 5:
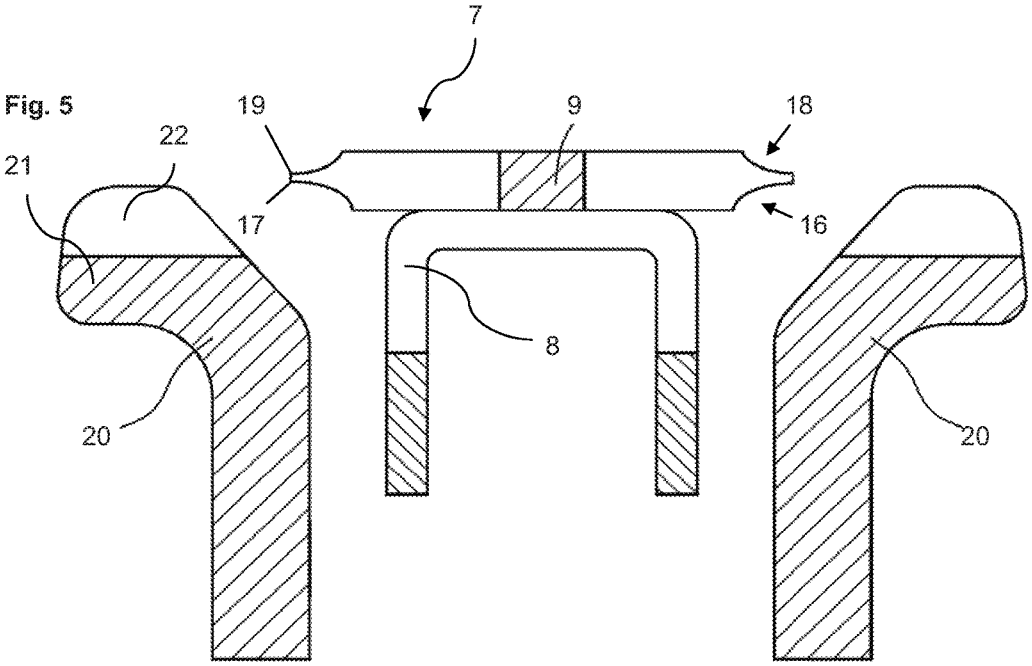
FIG. 5 shows a sectional view of an alternative upper blade according to the invention with a lower blade.

A similar embodiment is depicted in FIG. 5. Again, the outer blade 7 has the H-shaped configuration of FIG. 3 with a central web 9 and lateral webs 10 with slits 11 between the lateral webs 10. Further, the embodiment of FIG. 5 features the concave clearance 16 forming sharp edge 17. However, instead of the rounded upper edge 15 a further concave clearance 18 is formed between a side surface 14 and the upper surface 12, thereby forming an additional edge 19 with the side surface 14. Clearance 16 and further clearance 18 are spaced from one another such that a small portion of side surface 14 remains between edges 17 and 19. In a not shown alternative embodiment the size and position of clearances 16, 18 may be chosen such that edges 17, 19 are identical, i.e. without a remaining portion of side surface 14.

The design of outer blade 7 with two clearances may further improve the shaving result for hairs having an orientation substantially parallel to the skin. However, due to the additional edge 19 facing towards the user's skin, this design may be subject to skin irritation. To reduce possible skin irritations, guards 20 are arranged parallel to the outer blade 7.

Guards 20 may have a comb-like configuration with teeth 21 and slots 22 formed between teeth 21. The comb-like design of guards 20 may guide hairs into an orientation facilitating shearing and/or introducing the hairs in slits 11 of outer blade 7. Teeth 21 may have a rounded outer contour as shown in FIG. 5 to avoid skin irritations. Such guards 20 are also shown in FIGS. 1 and 2. Alternative guards are depicted in FIG. 3.

Figure 6:
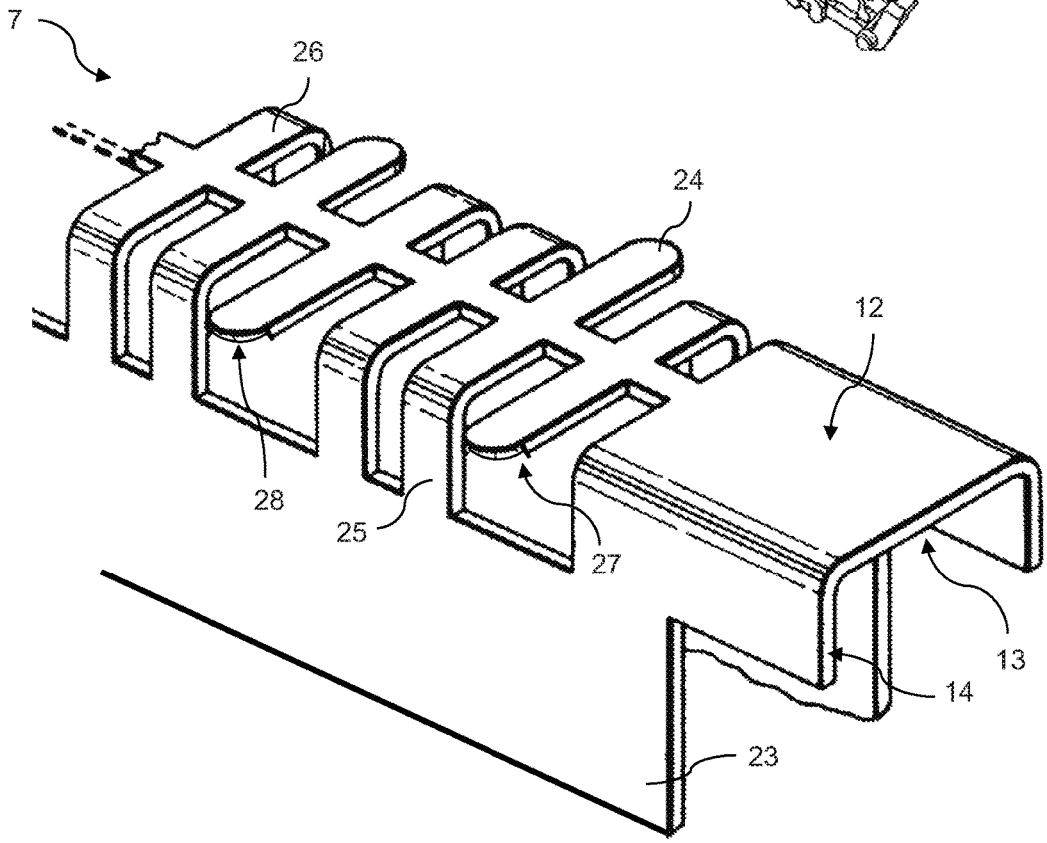
FIG. 6 shows a perspective view of an alternative upper blade according to the invention.

FIG. 6 shows a still further embodiment of an outer blade 7 of a slit cutter 6. The outer blade 7 comprises to oppositely disposed side walls 23 and a series of lateral webs 24. The lateral webs 24 are connected to the side walls 23 by vertically extending portions 25. In addition, bridge elements 26 are provided which are substantially U-shaped and connect the side walls 23. Clearances 27 are provided on the lower edge of the lateral tips of lateral webs 24, thereby generating a sharp edge 28 in the respective side surface of webs 24.

Given that the outer blade 7 has to be relatively thin to slide between the skin and a hair, production of the clearances 16 and/or 18 is difficult without damaging the structure of outer blade 7. A suitable method for producing outer blade 7 comprises the steps of providing a foil of a metallic material comprising the slits 11 and webs 9, 10, applying a protective layer at least on regions of at least one side of the webs 9 and/or 10, and exposing the at least one side of the webs to an etching agent thereby forming the concave clearance(s) 16, 18.

The production of the outer blade 7 using etching to provide the clearances has the benefit that the foil is not subjected to mechanical and/or thermal loads. Thus, the design of the previously formed structure of slits 11 and webs 9, 10 is not affected. In addition, an etching process is suitable for mass production of outer blades with high precision and high reproducibility.

If the etching process is based on photo-etching, the protective layer typically comprises a photoresist, i.e. an agent which may be cured by, e.g. UV, light and which is suitable to protect the material of the foil from the etching agent. The clearances are formed by applying the protective layer to the foil and by exposing regions, for example the region of the lower surface 13 which is intended to remain between the clearances 16, of the at least one side of the webs 9, 10 to light. This light exposure selectively cures the photoresist. Thereafter, un-cured photoresist, which defines the regions to be etched, is removed prior to exposing the at least one side of the webs to the etching agent. The etching agent may flow against the respective surface of the foil, thereby hollowing out the concave clearance. The cured protective layer may be removed after exposing the at least one side of the webs 9, 10 to the etching agent.

While FIGS. 4 to 6 show clearances 16, 18 only on lateral sides of lateral webs 10, such clearances (and respective edges 17, 19) may be provided at any desired position of the outer blade 7. For example, clearances may extend parallel to the second axis II and/or may be provided on central web 9. Further, a meander shaped web or other web structures may be fully or partially provided with clearances and respective edges.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An electric shaver comprising a motor, at least one slit cutter having an elongated outer blade, said elongated outer blade extending along a first axis and comprising a number of slits and webs disposed between the slits, wherein the webs have an upper surface, a lower surface and side surfaces extending between the upper and lower surfaces, wherein at least some of the webs are provided with a concave clearance formed between a side surface and the lower surface forming an edge with the side surface, and an inner blade driven by said motor to move in sliding contact with the outer blade, wherein at least one guard is provided adjacent to the slit cutter, wherein the at least one guard has a comb structure with teeth and slots provided between the teeth.

2. The shaver according to claim 1, wherein the shaver further comprises at least one foil-type cutter which is driven by the motor.

3. A method for producing an electric shaver according to claim 1 comprising the steps of:

providing a foil of a metallic material comprising a number of slits and webs, applying a protective layer at least on regions of at least one side of the webs, exposing the at least one side of the webs to an etching agent thereby forming a concave clearance between a side surface and the lower surface of the respective web.

4. The method according to claim 3, wherein the protective layer comprises a photoresist, wherein regions of the at least one side of the webs are exposed to light, thereby selectively curing the photoresist, and wherein un-cured photoresist is removed prior to exposing the at least one side of the webs to the etching agent.

5. The method according to claim 3, wherein the protective layer is removed after exposing the at least one side of the webs to the etching agent.

6. The method according to claim 3, wherein at least one rounded edge is formed between a side surface and the upper surface of at least some of the webs by an abrasive method.

7. The electric shaver according to claim 1, wherein the clearance forms an obtuse angle with the side surface and/or with the lower surface.

8. The electric shaver according to claim 1, wherein a central web is provided extending along the first axis with further lateral webs protruding from the central web and extending along a second axis.

9. The electric shaver according to claim 1, wherein the blade further comprises lateral wall elements, wherein the lateral wall elements are connected with each other and/or with webs by at least one bridge element.

10. The electric shaver according to claim 1, wherein at least some of the webs extend along the second axis which is perpendicular to the first axis, wherein a clearance is provided at least in a side surface facing in the direction of the second axis.

11. The electric shaver according to claim 1, wherein an edge formed between a side surface and the upper surface is a rounded edge.

12. The blade according to claim 1, wherein at least some of the webs are provided with a further concave clearance formed between a side surface and the upper surface forming an edge with the side surface.

13. The blade according to claim 12, wherein the concave clearance and the further concave clearance are spaced from each other by a portion of side surface.

* * * * *